US006805470B1

(12) United States Patent
Ward

(10) Patent No.: US 6,805,470 B1
(45) Date of Patent: Oct. 19, 2004

(54) LIGHT FIXTURE INCLUDING AN IMPROVED LATCH MECHANISM

(75) Inventor: Lee Ward, Gaffney, SC (US)

(73) Assignee: Ardee Lighting/USA, Inc., Shelby, NC (US)

( * ) Notice: Subject to any disclaimer, the term of this patent is extended or adjusted under 35 U.S.C. 154(b) by 0 days.

(21) Appl. No.: 10/438,028

(22) Filed: May 15, 2003

(51) Int. Cl.[7] ..... F21V 17/18
(52) U.S. Cl. ..... 362/374; 362/223; 362/455
(58) Field of Search ..... 362/374, 375, 362/370, 455, 223, 224

(56) References Cited

U.S. PATENT DOCUMENTS

| | | | | |
|---|---|---|---|---|
| 1,660,170 A | | 2/1928 | Kuen | |
| 1,729,892 A | | 10/1929 | Neuner | |
| 2,797,312 A | * | 6/1957 | Fletcher | 362/375 |
| 3,654,453 A | | 4/1972 | Jablonski | 240/25 |
| 3,697,743 A | | 10/1972 | Eargle | 240/147 |
| 3,748,465 A | | 7/1973 | Murray et al. | 240/147 |
| 5,172,976 A | | 12/1992 | Bogdanovs | 362/374 |
| 5,865,532 A | | 2/1999 | Bonazzi | 362/374 |
| 6,231,214 B1 | | 5/2001 | Haugaard | 362/375 |
| 6,267,491 B1 | | 7/2001 | Parrigin | 362/546 |
| 6,525,890 B1 | * | 2/2003 | Wang et al. | 359/896 |

* cited by examiner

*Primary Examiner*—Alan Cariaso
*Assistant Examiner*—Mark Tsidulko
(74) *Attorney, Agent, or Firm*—Fitzpatrick, Cella, Harper & Scinto

(57) ABSTRACT

A light fixture that includes a lens, a latch member, and a housing is provided. The light fixture includes an open top and a pair of generally parallel walls extending adjacent to the open top. The lens includes a pair of generally parallel side edges that include a leg on the lower portion of the side edge and a rib on the upper portion of the side edge above the leg. The latch member has a general L-shape, and includes legs for attaching and detaching the lens to the housing. The housing includes longitudinal grooves for receiving the latch member and lens. When the latch member is in the closed position, one leg of the latch member overlies the lens and a rib member on the lens is received by a recess in the latch member.

10 Claims, 3 Drawing Sheets

LIGHT FIXTURE INCLUDING AN IMPROVED LATCH MECHANISM

BACKGROUND OF THE INVENTION

1. Field of the Invention

The present invention relates generally to the field of light fixtures and more specifically, to an apparatus for securing a lens to a light fixture housing in a relatively watertight seal.

2. Background of the Invention

Various light fixtures have been designed in the past for use in damp or wet environments which require sealing the fixture to protect the lamps and wiring inside the fixture. Usually such systems are relatively complex and are difficult to open and close when repairing the internal wiring or replacing the lamps or bulbs therein.

A number of fixtures have previously been designed which include various forms of latch mechanisms that allow release of the protective lens or some other portion of the fixture for access to its interior. For example, U.S. Pat. No. 5,865,532 discloses a light fixture with a device for securing a transparent screen or lens to the base of a light fixture. The lens is secured to the base by a plurality of separately operable flexible hook-shaped elements. Thus, the force holding the lens in place is applied at discrete points and an effective seal along the entire edge of the lens cannot be formed.

U.S. Pat. No. 3,654,453 discloses a latch mechanism that includes a movable member having an end which engages a catch element provided on the housing of a light fixture. The single latch mechanism holds a lens in place against the housing in one location and does not create a seal along the entire edge of the lens.

U.S. Pat. No. 1,729,892 discloses a lamp body and door fastening device which includes a clip arrangement that holds a lens in place with a substantially watertight seal. However, the clip is not easily operable without tools to remove the lens for bulb replacement.

U.S. Pat. No. 6,267,491 relates to a lens retention means for a vehicle's lamp assembly in which the lens snaps into the housing. U.S. Pat. No. 5,172,976 discloses a light fixture that uses a pair of latch/hinge assemblies on one side of the lens and a pair of latch assemblies on the other side of the lens to secure the lens to the light fixture's housing.

In addition to the above, there are known light fixtures that require that an end plate be removed to allow access for relamping the light fixture. These, and other known light fixtures, require that two or more fasteners be removed from the light fixture's housing to relamp the light fixture. One problem with such fasteners is that after being removed, they become dislodged from the light fixture, i.e., they become loose and can fall from the work area onto pedestrians walking on the street below or into sewers, drains, etc. These light fixtures can become especially cumbersome to use when a light fixture mounted on a side of a building or several hundred feet in the air has to be repaired or relamped.

Thus, the prior art does not teach or suggest a light fixture that uses a quick release, easy to use, latching mechanism that makes relamping the fixture simple.

SUMMARY OF THE INVENTION

It is therefore an object of the present invention to provide a light fixture with a latching mechanism that makes relamping the light fixture simple.

It is another object of the present invention to provide a light fixture with an easy-to-remove lens for accessing the internal mechanisms of the light fixture.

It is still another object of the present invention to provide a light fixture that produces a simple water resistant or watertight seal between a lens and the fixture's housing.

It is yet another object of the present invention to provide a light fixture that includes a latching mechanism that remains connected to the housing after being released.

According to one aspect of the present invention, the light fixture includes a lens having two side edges including depending legs whose bottom surfaces are formed to mate with gaskets in corresponding grooves in the housing. Latch members are rotatably mounted on the housing along the two main side edges of the light fixture to clamp the lens in place against the gaskets along substantially their entire lengths. The latch members have first and second angularly related legs, the first of which includes a generally cylindrical rib. A recess is formed on an inner surface of the latch member adjacent the junction between the two legs. The bottom portions of the legs of the lens fit in the longitudinal grooves and compress the gaskets therein when the latch is closed. The cylindrical rib of the latch is received in a first longitudinal groove in the housing to rotate freely therein. When the latch is closed, the second leg of the latch rotates upward, so that it overlies the lens. In that position, the recess of the latch engages a mating edge of the lens in an over-the-center type action, which applies a clamping face to the lens along the entire length of the lens.

The above and other objects, features and advantages of this invention will be apparent to those skilled in the art from the following detailed description of illustrative embodiments of the invention, which is to be read in connection with the accompanying drawings, wherein:

DETAILED DESCRIPTION OF THE PREFERRED EMBODIMENTS

As mentioned above, the present invention is directed to a light fixture, and in particular, to light fixture including a latching mechanism for holding a lens securely in place on the light fixture's housing, preferably with a watertight seal. The light fixture can be used in a variety of indoor and outdoor applications including under cabinets, in coves, display cases, around baseboards, on shelves, staircases, railings, kitchens, and on decks. The light fixture can also be used in up-light and down-light applications.

Figure 1:
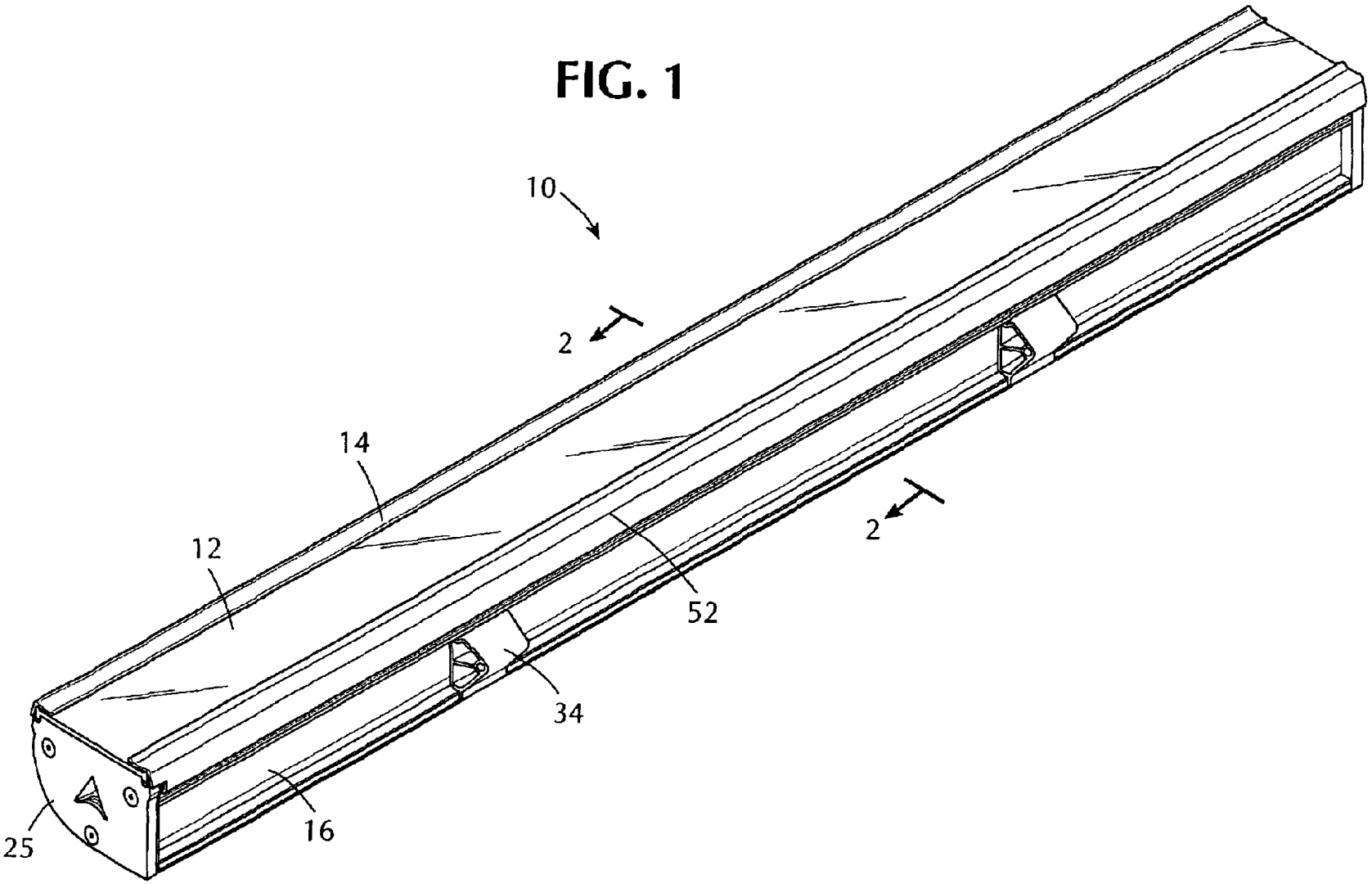
FIG. 1 is a top perspective view of a light fixture including a latching mechanism constructed in accordance with the present invention.

Referring now to the drawings in detail, and initially to FIG. 1, a light fixture 10 is illustrated which includes a lens 12, latch members 14, 52 and a housing 16. Light fixture 10 preferably is designed to contain a miniature low voltage linear light unit 26 such as shown in U.S. Pat. No. 4,979,081 and sold by Ardee Lighting USA, Inc. The linear light unit 26 (seen in FIG. 2) includes a support 28 containing a series of connectors 30 which support a plurality of festoon bulbs 32. Housing 16 preferably has a smaller size, such as for example, two-inches high and two-and-a-half inches wide from its front side 18 to its rear side 20. This allows light fixture 10 to be used in more restrictive spaces. As seen in FIG. 1, lens 12 is flat and extends the length of housing 16, which can be of any desired cross-sectional shape and in any desired length.

Latch members 14, 52 secures lens 12 to housing 16 in a substantially watertight seal along the front and rear sides 18, 20 of the housing. The latter is a generally U-shaped trough including front and rear upper surfaces 22, 24 to which lens 12 is mounted. The opposed ends of the housing 16 are closed by end plates 25, only one of which is seen in FIG. 1. Each end plate 25 has flush ends to allow the seamless mounting of multiple light fixtures 10 end-to-end, i.e., with no gap in between each light fixture 10.

Figure 2:
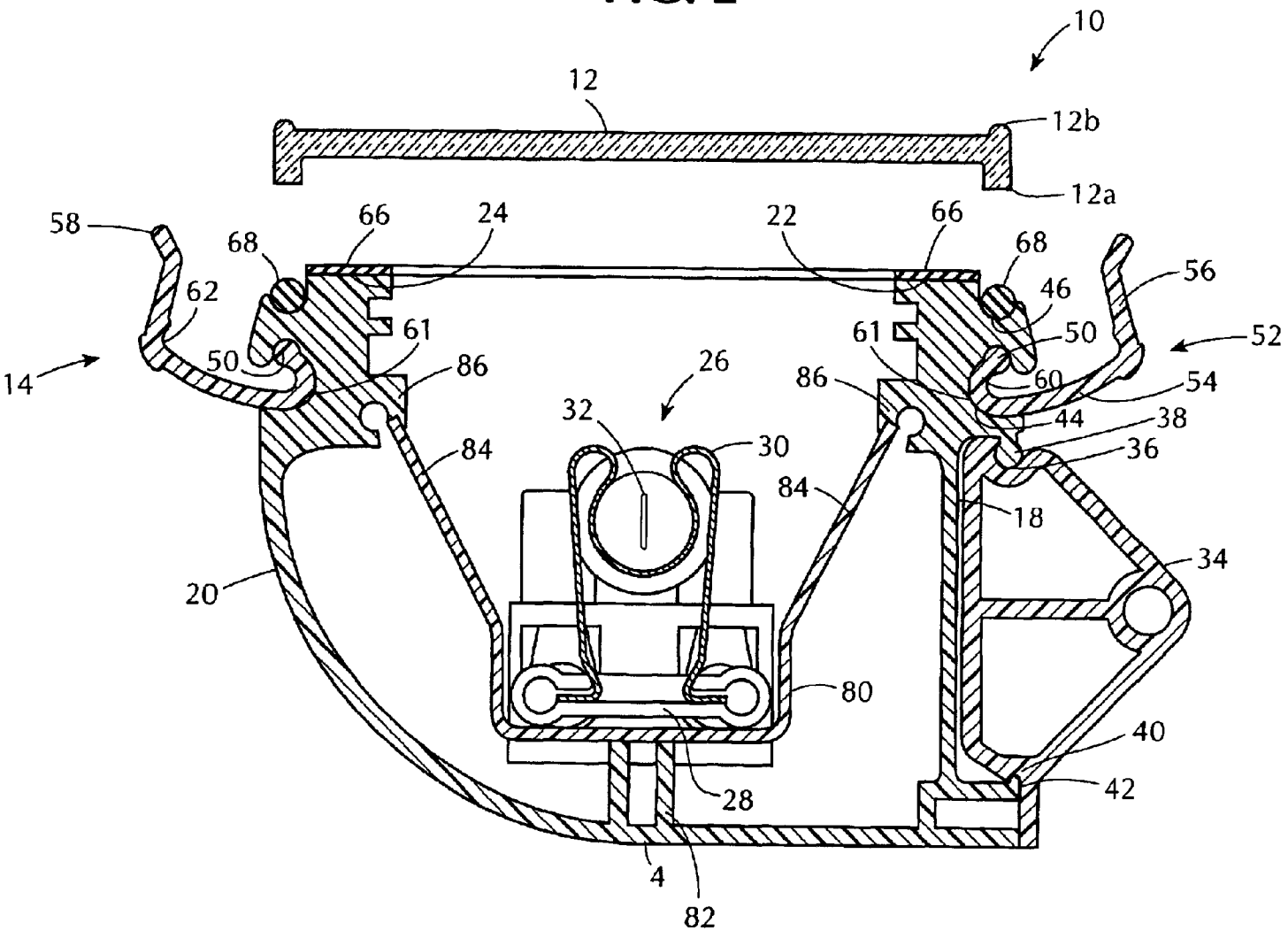
FIG. 2 is a sectional view taken along line 2—2 of FIG. 1 with the latching mechanism shown in the open position and the lens spaced from the housing.
Figure 3:
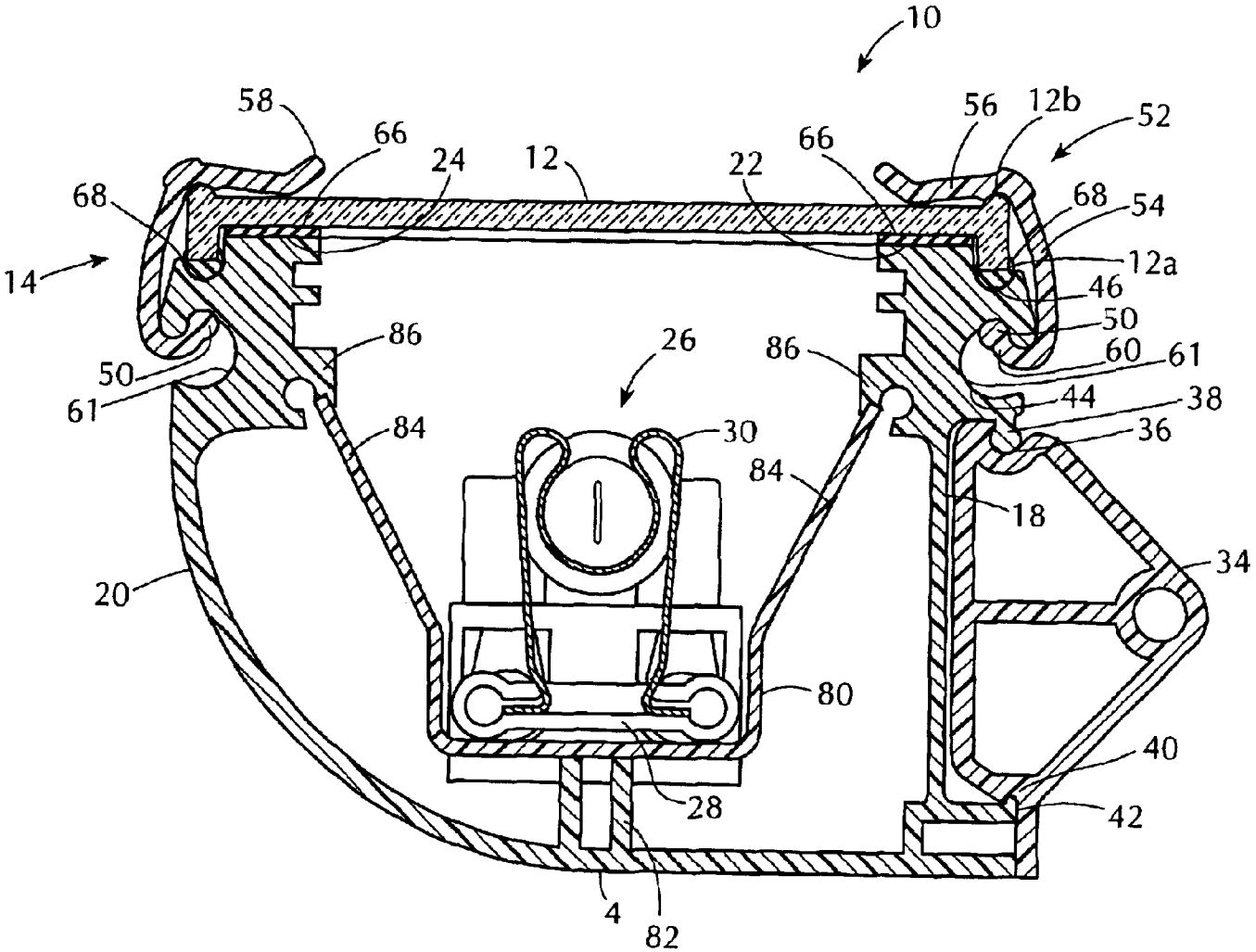
FIG. 3 is a sectional view similar to FIG. 2, with the latching mechanism shown in the closed position securing the lens to the housing.

As seen in FIGS. 2 and 3, a mounting bracket 34 is provided for securing light fixture 10 to a wall, ceiling or the like. Bracket 34 includes an upper longitudinal groove 36 which receives a cylindrical rib 38 formed in the side 18 of housing 16. In addition, housing 16 includes a longitudinal rib 42 adapted to snap into a longitudinal groove 40 on bracket 34. Thus, housing 16 can be snap fitted on the bracket 34 by first placing rib 38 in groove 36 and rotating the housing 16 in a counterclockwise direction, as seen in FIG. 2, to snap rib 42 into groove 40. Light fixture 10 can also be mounted to a support structure by tape and other means understood by those skilled in the art.

Side 18 (seen in FIG. 2) of housing 16 preferably includes a ⅜-inch NPT watertight connector (not seen in FIG. 1) for the electrical wiring. The light fixture's materials preferably comprise an aluminum housing, aluminum end plates, and a clear, UV protected, polycarbonate lens 12. It will be understood by those skilled in the art that the light fixture's 10 shape, size, composition, etc. can be readily changed to fit a particular application.

Referring again to FIG. 2, a light strip support member 80 is seated on ribs 82 in housing 16 and has stabilizing legs 84 engaged with interior ribs 86 in the housing.

Latch members 14, 52 are seen in their open position in FIG. 2 with lens 12 spaced from housing 16. Lens 12 has legs 12*a* extending in an upward and downward direction perpendicular to the main lens body. The top portions of legs 12*a* preferably include a curved rib or edge 12*b*, generally having a concave shape along the two long edges of lens 12. Latch members 14, 52 are provided along each long edge of housing 16. Each one of the latch members 14, 52 includes two legs 54, 56 formed in a generally L-shaped configuration in cross section.

Housing 16 includes a pair of longitudinal grooves 44,46 formed on opposite sides of a flange 48 extending outwardly from front and rear sides 18, 20 of housing 16 and extending the entire length thereof. The first longitudinal groove 44 preferably has a concave shape and receives a resilient cylindrical 50 on one leg 54 of each one of the latch members 14, 52. The second longitudinal groove 46 preferably has a semi-circular shape and receives a cylindrical sealing gasket 68 made of materials known in the art.

The legs 54 of the latch members 14, 52 each have a hook-shaped end whose free edge 60 includes the cylindrical 50. Channels 61 are formed in the front and rear sides 18, 20 of the housing 16, adjacent the grooves 44 and are generally complementary to the hook end of latch members 14, 52 to prevent the latch members 14, 52 from becoming dislodged from the grooves 44 when in their open position during normal operation.

Latch members 14, 52 also include a recess 62, formed on the latch's inner surface at the juncture between legs 54, 56. The leg 56 includes a raised end 58 for quick and easy opening of the latch members 14, 52.

Preferably, the upper front and rear surfaces 22, 24 of the front and rear sides 18, 20 of the housing 16 have flat surfaces on which flat gaskets 66 are placed to engage the under surfaces of the lens 12 and aid in forming a watertight seal.

To close and seal the housing 16, lens 12 is placed on the housing with the bottom surface of the lens 12 engaged with gasket 66 and the bottom portions of the legs 12*a* extending into grooves 46 to engage the cylindrical gasket 68. The latch members 14, 52 are then rotated clockwise and counterclockwise, respectively, as viewed in FIG. 2. This causes the hook end of leg 54 to pivot inside the corresponding channel 61 with its rib rotating in groove 44. As a result, the latch members 14, 52 move over the top of the lens 12, until the concave recess 62 mates with, and snaps onto, the mating edge 12*b* of the top portion of the legs 12*a*. Lens 12 is thus held in place against the flat gaskets 66, upper front and rear sealing surfaces 22, 24 of the front and rear sides 18, 20 of housing 16, and cylindrical gasket 68 to provide a watertight seal. As noted above, the latch members 14, 52 provide the desired sealing face along the entire length of the fixture 10.

During a subsequent opening operation, the raised end 58 of each one of the latch members 14, 52 is simply lifted up, causing the concave recess 62 to disengage from mating edge 12*b* of the leg 12*a*. The leg 54 rotates inside the corresponding grooves 44. The lens 12 can then be removed from the housing 16 and the fixture 10 can be easily relamped.

Although an illustrative embodiment of the present invention has been described herein with reference to the accompanying drawings, it is to be understood that various changes and modifications may be effected therein by those skilled in the art without departing from the scope or spirit of this invention.

What is claimed is:

1. A light fixture comprising:

a housing having an open top and a pair of generally parallel wall portions extending adjacent to said open top;

an elongated lens having a pair of generally parallel side edges, each of the side edges including a depending leg, said lens further comprising rib members on the upper surfaces of said lens above said legs; and a generally L-shaped latch member having first and second angularly related legs, the first leg having a free end including a generally cylindrical pivot rib member formed thereon, and a recess formed on the inner surface of said latch member at the juncture of said legs, wherein said housing further comprises a first longitudinal groove formed thereon for receiving said pivot rib member, whereby in the closed position of the latch member the second leg of said latch member overlies said lens and the rib member on said lens is received by the recess of said latch member.

2. The light fixture according to claim 1, wherein said housing member further comprises a second longitudinal groove formed thereon for receiving the depending leg of said lens.

3. The light fixture according to claim 2, wherein a sealing member is capable of being disposed in the second longitudinal groove.

4. The light fixture according to claim 2, wherein the first longitudinal groove and the second longitudinal groove extend the entire length of said housing.

5. The light fixture according to claim 1, wherein said latch member extends the entire length of said housing.

6. The light fixture according to claim 5, wherein said light fixture includes no more than two of said latch members.

7. The light fixture according to claim 1, wherein the second leg of said latch member further comprises a raised end.

8. The light fixture according to claim 1, wherein, when said latch member is in the open position, the first leg of said latch member is configured to rotate in the first longitudinal groove of said housing without the first leg becoming dislodged from the first longitudinal groove.

9. A light fixture comprising:

a housing having an open top and a pair of generally parallel wall portions extending adjacent to said open top;

an elongated lens having a pair of generally parallel side edges, each of the side edges including a depending leg, said lens further comprising rib members on the upper surfaces of said lens above said legs; and a generally L-shaped latch member having first and second angularly related legs, the first leg having a free end including a generally cylindrical pivot rib member formed thereon, and a recess formed on the inner surface of said latch member at the juncture of said legs, wherein said housing further comprises a first longitudinal groove formed thereon for receiving said pivot rib member, whereby in the closed position of the latch member the second leg of said latch member overlies said lens and the rib member on said lens is received by the recess of said latch member and wherein said housing member further comprises a second longitudinal groove formed thereon for receiving the depending leg of said lens.

10. A light fixture comprising:

a housing having an open top and a pair of generally parallel wall portions extending adjacent to said open top;

an elongated lens having a pair of generally parallel side edges, each of the side edges including a depending leg, said lens further comprising rib members on the upper surfaces of said lens above said legs; and a generally L-shaped latch member having first and second angularly related legs, the first leg having a free end including a generally cylindrical pivot rib member formed thereon, and a recess formed on the inner surface of said latch member at the juncture of said legs, wherein said housing further comprises a first longitudinal groove formed thereon for receiving said pivot rib member, whereby in the closed position of the latch member the second leg of said latch member overlies said lens and the rib member on said lens is received by the recess of said latch member, wherein said housing member further comprises a second longitudinal groove formed thereon for receiving the depending leg of said lens, and wherein a sealing member is capable of being disposed in the second longitudinal groove.

* * * * *